US006994505B2

(12) United States Patent
Hawkins, III

(10) Patent No.: US 6,994,505 B2
(45) Date of Patent: Feb. 7, 2006

(54) PICK-UP AND LAY-DOWN SYSTEM AND METHOD

(75) Inventor: Samuel P. Hawkins, III, Lafayette, LA (US)

(73) Assignee: Frank's International, Houston, TX (US)

( * ) Notice: Subject to any disclaimer, the term of this patent is extended or adjusted under 35 U.S.C. 154(b) by 21 days.

(21) Appl. No.: 10/754,160

(22) Filed: Jan. 9, 2004

(65) Prior Publication Data

US 2005/0152772 A1 Jul. 14, 2005

(51) Int. Cl.
*E21B 19/00* (2006.01)

(52) U.S. Cl. ..... 414/22.54

(58) Field of Classification Search ..... 414/22.51, 414/22.54, 22.57, 22.58, 22.59, 22.61, 22.63, 414/22.65

See application file for complete search history.

(56) References Cited

U.S. PATENT DOCUMENTS

| | | | | |
|---|---|---|---|---|
| 4,380,297 | A * | 4/1983 | Frias | 414/22.61 |
| 4,382,591 | A * | 5/1983 | Minnis et al. | 414/22.61 |
| 4,439,091 | A * | 3/1984 | Frias | 414/22.59 |
| 6,533,519 | B1 * | 3/2003 | Tolmon et al. | 414/22.54 |
| 6,695,559 | B1 * | 2/2004 | Pietras | 414/22.57 |

* cited by examiner

*Primary Examiner*—Richard Ridley
(74) *Attorney, Agent, or Firm*—The Matthews Firm

(57) ABSTRACT

A pick-up and lay-down pipe handling system and method provides a telescopingly extendable pipe trough which is telescopingly extendable from a lift frame. The lift frame is preferably pivotally moveable with respect to a support. A tilting mechanism is operable for tilting the pipe trough to either lateral side for unloading and/or loading purposes. A lift frame with slidable powered lift heads is provided to raise and lower pipes from a pipe rack to the pipe trough. A pivotal guide member on the slidable powered lift head to pivot into a guiding position for guiding pipe from the lift frame onto the pipe trough.

26 Claims, 6 Drawing Sheets

PICK-UP AND LAY-DOWN SYSTEM AND METHOD

TECHNICAL FIELD

The present invention relates generally to apparatus and methods operable for automatically lifting and lowering oilfield tubulars and, more particularly, is especially suitable for lifting large diameter tubulars of heavy weight or other tubulars which are especially prone to lateral impact and friction damage during transport due to their significant weight.

BACKGROUND ART

Prior art oil field pipe handling systems and methods are well known for lifting and lowering drill pipe and casing to and from pipe racks, to and from the catwalk, and then onto the rig floor, and/or for stacking the pipe at other locations adjacent to or separated from the rig floor. However, the prior art systems have problems relating to damage of the tubulars during this process. Moreover, prior art systems are limited in their adaptability to the path of transportation typically to and from each particular rig floor, catwalk, and pipe rack arrangement.

Numerous U.S. Patents show various attempts to provide suitable devices, methods, and machines for handling drilling tubulars of various types and under various work situations and for various work environments. However, the prior art does not provide a suitable means for moving pipes whereby they arrive at the rig floor virtually without experiencing sharp lateral impacts and/or friction damage to sensitive areas such as threads. For instance, heavy tubulars such as casing, due to their very great weight and large diameter may be easily damaged by lateral impacts and/or even by impacts to thread protectors during movement from the pipe rack, to the cat walk, and then to the drill floor. The transportation from a pipe rack to the rig floor often involves an irregular and difficult path for moving heavy items. Moreover, this pathway will often vary depending on the particulars of construction for each drilling, workover, offshore, and/or onshore rig.

It would be desirable to provide a machine which will handle all types of pipes and which adapt to the many different transportation pathways, for transporting tubulars from pipe racks to the rig floor without damage even to extremely heavy, large, tubulars and/or to other tubulars prone to damage due to sharp lateral impacts or impacts to the sensitive threaded ends thereof.

Consequently, those of skill in the art will appreciate the present invention which addresses the above and other problems.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

GENERAL DESCRIPTION AND PREFERRED MODE FOR CARRYING OUT THE INVENTION

Figure 1:
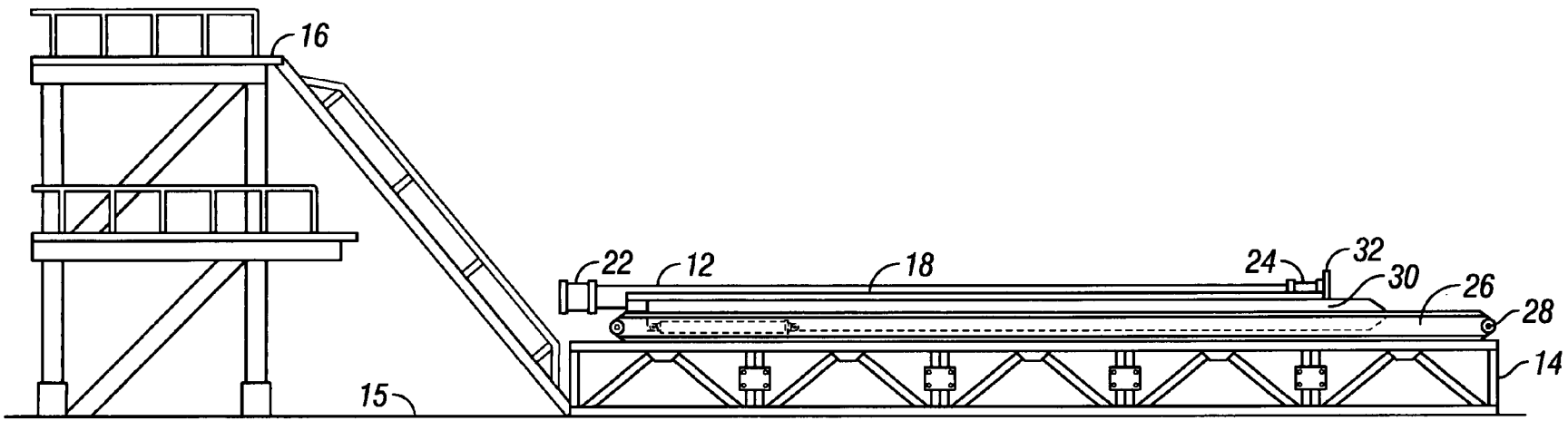
FIG. 1 is an elevational view, partially in phantom lines, of one possible embodiment of a system and method with a pipe just mounted thereon for movement to the rig floor from the catwalk in accord with the present invention.

Referring now to the drawings and, more particularly, to FIG. 1, FIG. 2, FIG. 3, and FIG. 4, there is shown a series of elevational views of a presently preferred embodiment of pipe handling system 10 during operation. System 10 gently guides pipe 12, which may be a very large diameter pipe such as surface casing, or drill pipe, or any other type of pipe, from catwalk 14. Catwalk 14, as used herein may refer to any other platform or lower location which leads up to rig floor 16. Rig floor 16, as used herein, may be a drilling rig floor, workover rig floor, derrick floor, pipe storage location, or any other location which is generally elevated with respect to a lower position, such as 14 catwalk, the pipe rack, or other pipe storage locations. A rig may be an offshore rig, workover rig, drilling rig, and the like, for working with well bores. Special apparatus for placing pipe 12 onto moveable trough 18 or removing pipe 12 from moveable trough 18 to/from another location such as a pipe rack or lower location or possibly an upper location, are not shown in this series of figures but presently preferred and innovative features are shown in FIG. 5 and FIG. 6, as discussed hereinafter.

Figure 5:
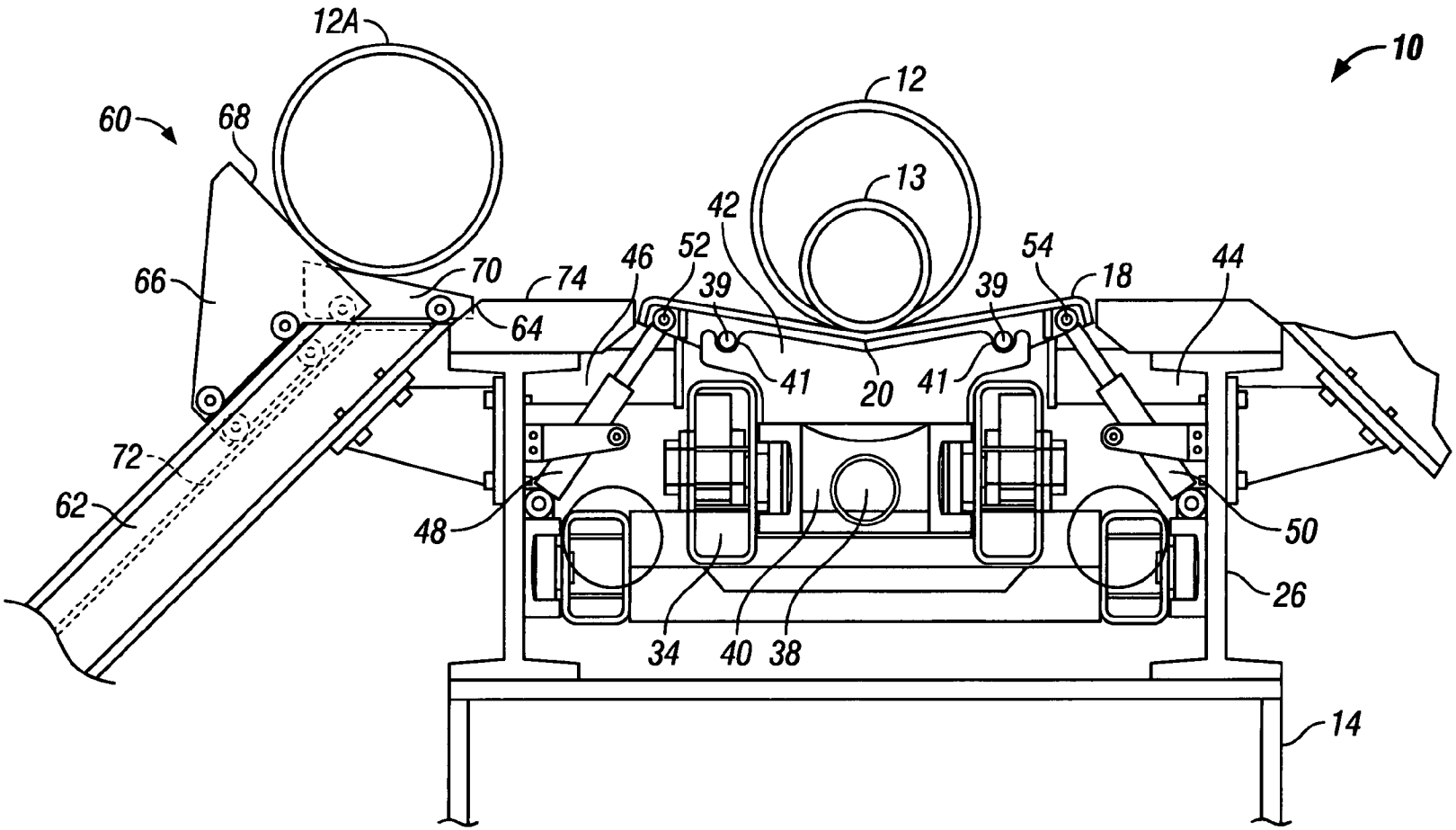
FIG. 5 is a cross-sectional view, partially in phantom lines, of the embodiment of FIG. 1 wherein a pipe is shown in various stages of movement from a pipe rack or other pipe support to a slidable trough in accord with the present invention.
Figure 6:
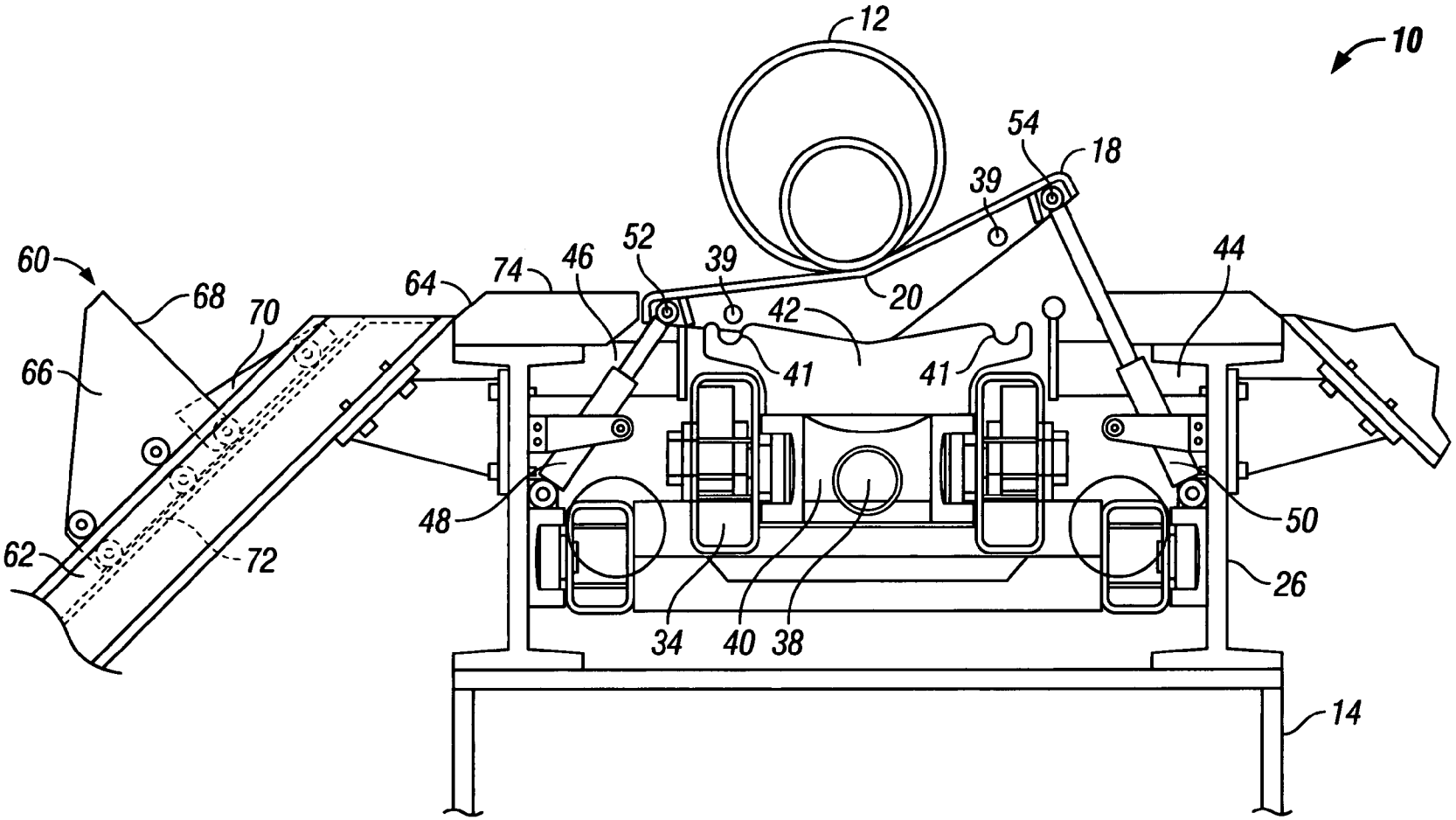
FIG. 6 is a cross-sectional view, partially in phantom lines, of the system in FIG. 5 illustrating that the trough can be tilted in either direction as desired for loading and unloading.

As seen in FIG. 5 and FIG. 6, trough 18 preferably has a cross-section that is generally smooth with a relatively wide sloping surface with a generally lower center 20 into which the pipe is guided by gravity. Note that trough 18 is preferably relatively wide and therefore can handle very large pipe. The entire trough or substantially the entire lateral width is preferably slightly V-shaped, curved as desired, or configured to thereby gently direct pipe 12 to center 20. In a presently preferred embodiment, trough 18 is not planar or flat but gradually sloping along its entire lateral width for guiding purposes. Because of this gradual sloping, if desired, multiple drill pipes (which are generally much smaller in diameter than some types of casing, e.g., surface casing) could be placed on trough 18 for simultaneous movement, if desired. Moreover, trough 18 is preferably smooth along its axial length without bumps, rivets, bolts, ridges or the like which could cause impacts when pipe 12 is placed on or removed from trough 18. Thus, mechanical connections to trough 18 may be made below trough 18 to avoid a rough surface, if desired.

In the operating position of system 10 shown in FIG. 1, pipe 12 is substantially parallel to trough 18. Pipe 12 is also substantially parallel to platform 26. Pipe 12 is also substantially parallel to the surface of catwalk 14 or other surface from which pipe 12 is to be moved. Before being picked-up, or after being layed-down, pipe 12 is also typically in the same plane as the pipe rack and/or ground 15 which may be located below or adjacent to catwalk 14. Trough 18 is slidably extendable and may not actually be connected directly to platform 26. Trough 18 is supported by lift frame 30 which may be pivotally and/or slidably pivotally mounted with respect to platform 26. As a rough comparison, trough 18 extends from lift frame 30 like a fireman's ladder extends outwardly. Accordingly, trough 18 is preferably not rigidly mounted and has no rearward fixed connection to platform 26. The length of trough 18 may or may not reach to or past platform end 28, as desired. Platform 26 rests on catwalk 14 or any other desired surface which will typically be below rig floor 16 although theoretically slidable trough 18 could move pipe 12 horizontally to rig floor 16 if rig floor 16 were substantially parallel or just below the plane of movement of pipe 12. Trough 18 preferably has foot member 32 positioned thereon to prevent movement of pipe 12 away from rig floor 16. Foot member 32 preferably engages thread protector 24 of pipe 12. If desired, foot member 32 may be moveable and/or adjustable.

Figure 2:
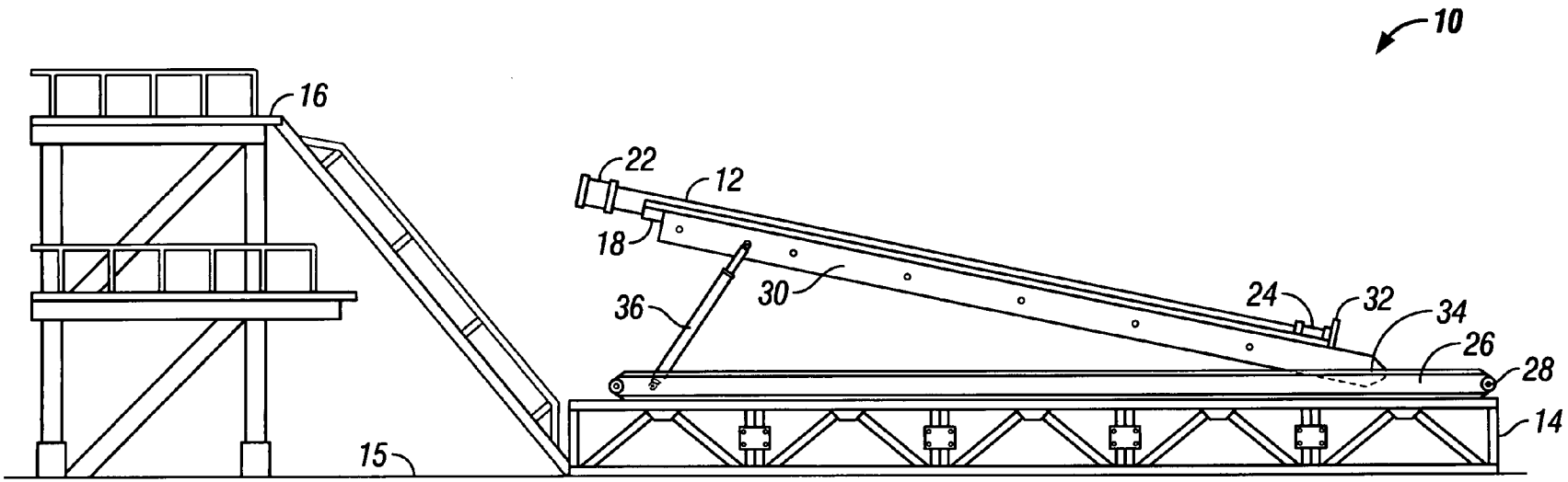
FIG. 2 is an elevational view, partially in phantom lines, of the embodiment shown in FIG. 1 as it initially lifts and adjusts in height for a particular rig floor.

In FIG. 2, it can be seen that lift frame 30 begins to angle upwardly towards the direction of rig floor 16. Connection 34 between lift frame 30 and platform 26 is preferably pivotally mounted but may be of many different types as desired. As an example, pivot members 34 shown in FIG. 5 and FIG. 6 may be utilized. If desired, for instance, the rear of lift frame 30 could also be raised upwardly from platform 26. However, in one presently preferred embodiment, a pair of hydraulic parallel jacks with hydraulic jack 36 shown in the foreground is utilized to move the end of lift frame 30 closest to rig floor 16 upwardly. Hydraulic jack 36 is preferably pivotally mounted with respect to both lift frame 30 and platform 26 and may be mechanically interconnected therebetween in a variety of ways, as desired. Moreover, various types of mechanical connections and other types or placements of lift devices such as hydraulic jack 36 may be utilized as desired with the net effect being to repeatedly raise and/or lower lift frame 30, trough 18, and, of course, pipe 12 during operation of system 10. Pipe 12 is prevented from sliding downwardly in trough 18 as lift frame 30 becomes more inclined by foot 32.

Figure 3:
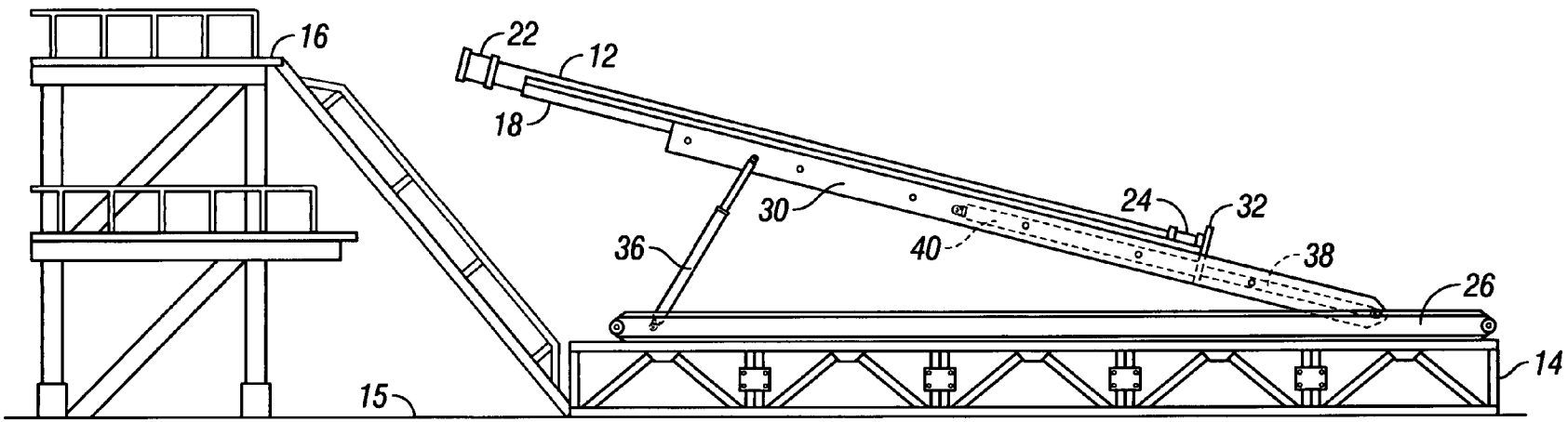
FIG. 3 is an elevational view, partially in phantom lines, of the embodiment shown in FIG. 1 wherein an entire trough for laterally supporting and carrying the pipe extends outwardly from a carrier the pipe so as to prevent any friction and/or lateral impacts acting on the pipe as the pipe moves in the direction of the rig floor.

In FIG. 3, trough 18 begins to extend outwardly from lift frame 30. While many possible mechanical arrangements may be utilized to perform the extension function, in a presently preferred embodiment, hydraulic jack with piston 38 and cylinder 40 may be mounted in lift frame 30 for this purpose. Cylinder 40 may be secured to foot 32 and/or other portions of trough 18 such that as cylinder 40 is hydraulically extended from piston 38 trough 18 extends outwardly from lift frame 30. Cylinder 40 and piston 38 may be provided with support elements and/or guide members that support and/or guide operational movement of cylinder 40 and piston 38. Interlocking connections may be utilized as desired and positioned as desired to provide support between cylinder 40, piston 38, lift frame 30 and trough 18.

Figure 4:
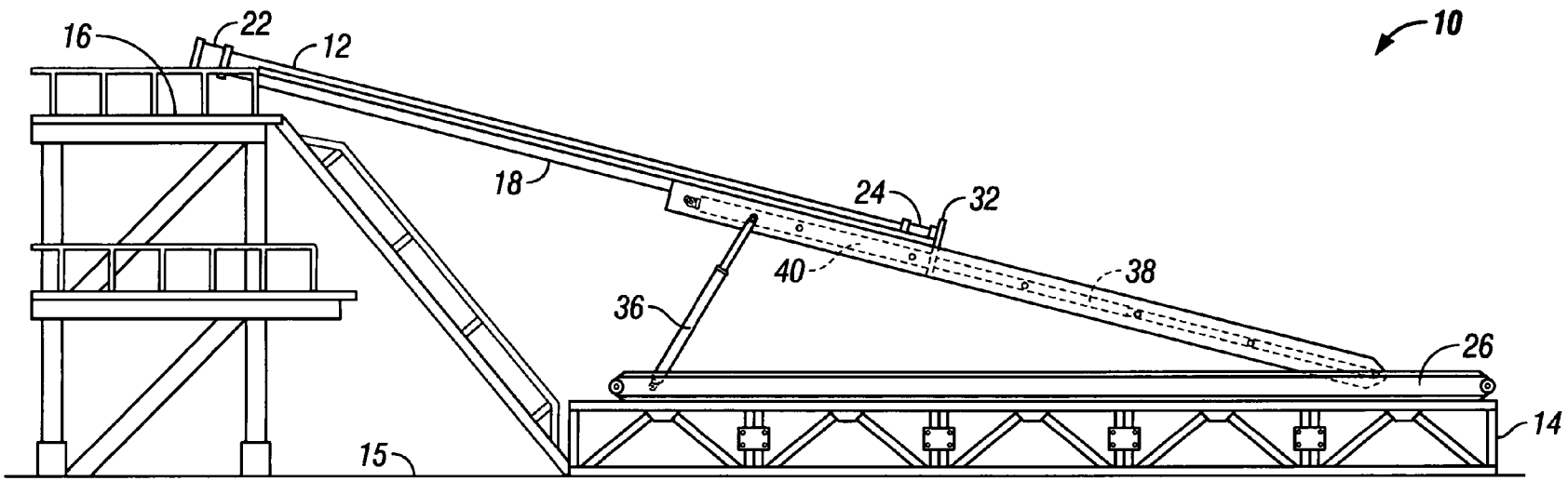
FIG. 4 is an elevational view, partially in phantom lines, of the embodiment shown in FIG. 1 wherein the trough is now at the rig floor.

FIG. 4 shows trough 18 extended to the desired position. It will be noted that pipe 12 has never moved, relative to trough 18, and has simply sat within trough 18 as trough 18 extends from lift frame 30. Thus, there have been virtually no lateral impacts or friction damage to pipe 12 during the extension/retraction movement of trough 18 with respect to lift frame 30. The rig crew will now typically engage end 22 of pipe 12 with the rig blocks or other lifting means so that thread protector 24 of pipe 12 slides along the smooth surface of trough 18 until suspended in air for assembly to a tubular string.

Preferably system 10 is sized so as to be easily trucked to a location. In other words, system 10 is preferably transportable from rig to rig rather than requiring system 10 to be incorporated into the rig. However, it should be appreciated that, if so desired, system 10 can be more permanently attached or otherwise located at the rig site. System 10 can be remotely controlled from either rig floor 16 or the ground, or other locations, as desired. Adjustable stops may be utilized for different size pipe joints and to start and stop operation at desired locations automatically. For reference of one possible embodiment and shown only for comparison purposes, trough 18 can accommodate various size tubulars and pipe. Here, as illustrated in FIG. 5 pipe 12 is a large diameter casing while pipe 13 relatively smaller diameter casing.

As discussed in FIG. 5 and FIG. 6, trough 18 is also pivotal along its axial length axis by hydraulic members for loading and unloading to either lateral side of trough 18. When in the lowered, contracted, position wherein trough 18 is fully collapsed or retracted as shown in FIG. 1, then trough 18 is supported by guide rails 39 and corresponding slots 41 on either side of trough 18 and one or more center braces 42 of lift frame 30 (see outer surface of lift frame 30 in FIG. 1–FIG. 4). Lift frame 30 may also preferably comprise outer support rails, such as outer rails 44 and 46. Trough 18 may be mounted to lift frame outer rails 44 and 46 by greased slidable connections, rollers, suitably positioned interlocking telescoping joints and/or other suitably positioned mechanical means whereby relative extension between two members is accomplished during the operation thereof.

When positioned in the lowered position, as shown from the side in FIG. 1, then trough 18 may be tilted in either direction by multiple hydraulic lifts on either side of trough 18 two of which are shown in FIGS. 5 and 6, namely hydraulic lifts 48 and 50. Hydraulic lifts, such as lifts 48 and 50 are secured to platform 26 which may rest on catwalk 14 or other suitable support, such as the ground. When trough 18 is in the lowered, retracted position, shown in FIG. 1, then the ends of fixed position hydraulic lifts, such as the ends of lifts 48 and 50, align with receptacles such as receptacles 52 and 54. Thus, preferably when in the lowered, collapsed position, trough 18 can be tilted as shown in FIG. 6, such as for unloading pipe 12, by extending at least one of hydraulic lifts 48 and 50. Each side of trough 18 will preferably have several hydraulic lifts and the lifts on each side act in concert to tilt trough 18. It will be best understood from viewing FIG. 5 and FIG. 6 that trough 18 can be tilted in either direction to permit unloading and/or loading of pipe from either side of trough 18 by controlling the relative amounts of extension of hydraulic lifts 48 and 50.

In one embodiment, pipe lift frame 62 preferably aids in the stabilization of system 10. In this embodiment, pipe lift frame 62 is fixedly attached to system 10. It should be understood that the exact attachment point for lift frame 62 can vary depending on the configuration parameters at the rig including, but not limited to, the location of the pipe rack and any space limitations. It should further be understood that pipe lift frame 62 can also be independent of system 10 and serve primarily to lift pipe 12, or pipe 13, to the trough 18. Still further, it should be appreciated that pipe lift frame 62 can help stabilize system 10 whether it is fixedly attached or detachably mounted.

In another aspect of the invention, hydraulic loader 60 may be utilized for loading and unloading pipe with respect to trough 18. While only hydraulic loader 60, and only one pipe lift frame 62, is shown, it will be understood that multiple hydraulic loaders 60 may be utilized to support the pipe along its length. Preferably, at least two hydraulic loaders 60 may be utilized. Pipe lift frame 62 may extend from edge 64 of platform 26 to the ground or to a lower floor and will preferably extend through a pipe rack (not shown) or the like where the pipe to be loaded/unloaded is provided. The pipe rack may be at the same horizontal level as catwalk 14, or lower, and may even be significantly lower. Conceivably the pipe rack could also be higher but then lifting member 66 would need to be reoriented. In the normal case where the pipe rack is lower, when powered pipe lifter 66 is lowered beneath the horizontal level of pipes on the pipe rack, a pipe can be rolled in position against pipe lift frame 62. When pipe lifter 66 comes upwardly, then the pipe, such as pipe 12A shown in FIG. 5, is trapped between pipe lift frame 62 by lifting surface 68 on powered pipe lifter 66 and is then raised upwardly to trough 18.

In a preferred embodiment, pipe lifter 66 comprises a pivotal pipe guide 70 which follows track 72, to gently guide pipe 12A onto rail 74 and into trough 18. Pivotal guide 70, rail 74, and trough 18 are aligned to prevent any lateral bumps or shocks to the pipe. In a reverse manner, pipe is unloaded from trough 18.

Thus, in operation to move pipe from a pipe rack to rig floor 16, powered pipe lifter 66 is lowered, a pipe is rolled against pipe lift frame 62. Powered pipe lifter 66 moves the pipe upwardly and rolls it gently onto trough 18 where it comes to rest in bottom groove 20. Lift frame 30 is then lifted upwardly, and trough 18 slides outwardly with respect to lift frame 30. To unload pipes, the reverse process takes place, except that the pipe can be rolled off of trough 18 by hydraulic lifts 48 and 50 to either side of trough 18, as desired. For instance, pipe lift frame 62 may be positioned on the opposite side of trough 18 than as shown.

The particular stopping points for each moveable element such as trough 18, powered pipe lifter 66, lift frame 30, and the like, can be set by controls, software, and suitable sensors and/or by mechanically moveable stop means, as desired, so that it is not necessary to manually adjust the stopping points for each cycle of operation.

It may be seen from the preceding description that a new and improved pipe pick-up and lay-down system and method has been provided. Although very specific examples have been described and disclosed, the invention of the instant application is considered to comprise and is intended to comprise any equivalent structure and may be constructed in many different ways to function and operate in the general manner as explained hereinbefore. Accordingly, it is noted that the embodiment of the new and improved pipe pick-up and lay-down system and method described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

I claim:

1. A pipe handling machine for moving a plurality of oilfield tubulars with respect to a rig floor, said pipe handling machine comprising:

an elongate moveable trough, said elongate moveable trough having a first lateral side and a second lateral side, said elongate moveable trough having a cross-sectional shape for receiving at least one oilfield tubular between said first lateral side and said second lateral side;

said elongate moveable trough being moveable to and from a first position away from said rig floor and a second position adjacent said rig floor;

one or more powered units for raising and lowering said elongate moveable trough toward and away from said rig floor;

a tilting mechanism for tilting said elongate moveable trough, said tilting mechanism being operable for tilting one lateral side to a higher elevation than the other lateral side; and a lift frame, said elongate moveable trough being axially extendable and retractable with respect to said lift frame.

2. The pipe handling machine of claim 1, wherein said pipe handling machine is operable from a remote location.

3. The pipe handling machine of claim 1, wherein said tilting mechanism is operable for tilting said elongate moveable trough to thereby unload an oilfield tubular laterally from said elongate moveable trough.

4. The pipe handling machine of claim 1, wherein said tilting mechanism further comprises a first hydraulic lift engageable with said first lateral side.

5. The pipe handling machine of claim 1, wherein said tilting mechanism further comprises a second hydraulic lift engageable with said second lateral side.

6. The pipe handling machine of claim 1, wherein said tilting mechanism is operable only when said elongate moveable trough is in said first position away from said rig floor.

7. The pipe handling machine of claim 1, further comprising one or more pipe lifting frames, each of said one or more pipe lifting frames further comprising a powered pipe lifter moveably mounted thereto, said powered pipe lifter being operable for lifting and lowering an oilfield tubular to and from said elongate moveable trough.

8. The pipe handling machine of claim 7, wherein said tilting mechanism is operable for tilting said elongate moveable trough to laterally unload said oilfield tubular from said elongate moveable trough to said powered pipe lifter.

9. The pipe handling machine of claim 7, further comprising a platform, and a lift frame being pivotally moveable with respect to said platform, said one or more pipe lifting frames being affixable to said platform.

10. A pipe handling machine for moving a plurality of oilfield tubulars with respect to a rig floor, said pipe handling machine comprising:

a lift frame;

one or more powered units for raising and lowering said lift frame with respect to said rig floor;

an elongate moveable trough supported by said lift frame, said elongate moveable trough being axially extendable and retractable with respect to said lift frame, said elongate moveable trough being shaped internally for receiving and supporting at least one of oilfield tubulars; and one or more powered units for axially extending and retracting said elongate moveable trough with respect to said lift frame by an extension length.

11. The pipe handling machine of claim 10, wherein said oilfield tubular is moveable toward or away from said rig floor by said extension length with little or no axial sliding movement occurring between an oilfield tubular carried by said elongate moveable trough and said elongate moveable trough while said elongate moveable trough operates to extend or retract by said extension length.

12. The pipe handling machine of claim 10, further comprising a platform, said lift frame being pivotally moveable with respect to said platform for pivoting said lift frame in the direction of said rig floor, elongate moveable trough being axially extendable towards and away from said rig floor once said lift frame is in a selected pivotal position with respect to said platform.

13. The pipe handling machine of claim 10, further comprising a trough foot member mounted to an end portion of elongate moveable trough for supporting an end of an oilfield tubular positioned in said trough.

14. The pipe handling machine of claim 13, wherein said trough foot member is fixed in position with respect to said elongate moveable trough when said elongate moveable trough is extended and retracted with respect to said lift frame.

15. The pipe handling machine of claim 13, wherein said trough foot member is movably mounted and wherein said trough foot member is adjustable to position varied length tubulars with respect to said elongate moveable trough.

16. The pipe handling machine of claim 10, further comprising a tilting mechanism for tilting said elongate moveable trough, said elongate moveable trough having a first lateral side and a second lateral side, said tilting mechanism lifting one lateral side to a higher elevation than the other lateral side.

17. The pipe handling machine of claim 16, wherein said tilting mechanism is operable for tilting said elongate moveable trough to thereby unload an oilfield tubular laterally from said elongate moveable trough.

18. The pipe handling machine of claim 16, wherein said tilting mechanism further comprises a first hydraulic lift engageable with said first lateral side.

19. The pipe handling machine of claim 18, wherein said tilting mechanism further comprises a second hydraulic lift engageable with said second lateral side.

20. The pipe handling machine of claim 10, further comprising one or more pipe lifting frames, each of said one or more pipe lifting frames further comprising a powered pipe lifter moveably mounted thereto, said powered pipe lifter being operable for lifting and lowering an oilfield tubular to and from said elongate moveable trough.

21. The pipe handling machine of claim 10, further comprising a platform, said lift frame being pivotally moveable with respect to said platform, said one or more pipe lifting frames being affixable to said platform.

22. A method for picking up or laying down oil field tubulars with respect to a rig floor, comprising the following steps in any order:

positioning at least one oil field tubular on an elongate trough;

telescopingly extending or retracting said elongate trough with respect to a support frame; and raising or lowering said support frame to thereby effect said picking up or laying down of said oil field tubular.

23. The method of claim 22, further comprising tilting one lateral side of said elongate trough with respect to an opposite lateral side of said elongate trough.

24. The method of claim 22, further comprising mounting one or more lift frames to a position adjacent said elongate trough when said elongate trough is retracted and lowered away from said rig floor, and providing a moveable powered pipe lifter on each of said one or more lift frames for moving said oilfield tubulars either to or away from said elongate trough.

25. A Pipe handling machine for moving a plurality of oilfield tubulars with respect to a rig floor, said pipe handling machine comprising:

an elongate moveable trough;

one or more powered units for raising and lowering a lift frame with respect to said rig floor between a first position closer to said rig floor and a second position further away from said ring floor with respect to said first position;

one or more pipe lifting frames affixed adjacent said second position;

a powered pipe lifter moveably mounted to each of said one or more pipe lifting frames, said powered pipe lifter being operable for lifting and lowering an oilfield tubular towards and away from said elongate moveable trough;

a pivotal member pivotally connected to said powered pipe lifter, said pivotal member being operable for pivoting to a guiding position for guiding an oilfield tubular to roll laterally onto said elongate moveable trough when said powered pipe lifter is adjacent said elongate moveable trough; and a lift frame, said elongate moveable trough being axially extendable and retractable with respect to said lift frame.

26. The pipe handling machine of claim 25, further comprising a platform, said lift frame being pivotally moveable with respect to said platform, said one or more pipe lifting frames being affixable to said platform.

* * * * *